US006071179A

United States Patent [19]

Sakai et al.

[11] Patent Number: 6,071,179

[45] Date of Patent: Jun. 6, 2000

[54] APPARATUS AND METHOD FOR GRINDING AND POLISHING SPHERICAL BODIES

[75] Inventors: Nobuo Sakai; Migaku Ishida, both of Fukuoka, Japan

[73] Assignee: Mitsui High-Tec Inc., Tokyo, Japan

[21] Appl. No.: 09/086,559

[22] Filed: May 29, 1998

[30] Foreign Application Priority Data

Jun. 2, 1997 [JP] Japan ..... 9-144366

[51] Int. Cl.[7] ..... B24B 7/22; B24B 1/00; B24B 47/20

[52] U.S. Cl. ..... 451/50; 451/49; 451/65; 451/324; 451/333

[58] Field of Search ..... 451/36, 37, 49, 451/50, 65, 324, 332, 333, 398, 402

[56] References Cited

U.S. PATENT DOCUMENTS

| | | | |
|---|---|---|---|
| 1,873,647 | 8/1932 | Hoke | 451/49 |
| 3,579,911 | 5/1971 | Steinmetz | 451/65 |
| 3,751,297 | 8/1973 | Minbiole, Jr. et al. | 134/30 |
| 3,889,428 | 6/1975 | Steinegger et al. | 451/261 |
| 5,214,883 | 6/1993 | Naumec et al. | 451/328 |
| 5,301,470 | 4/1994 | Sato | 451/284 |
| 5,315,791 | 5/1994 | Iwai et al. | 451/269 |

*Primary Examiner*—Timothy V. Eley
*Attorney, Agent, or Firm*—Greenblum & Bernstein, P.L.C.

[57] ABSTRACT

A spherical body grinding and polishing apparatus comprises: a rotary shaft having a spiral path groove in the outer cylindrical surface along which spherical bodies to be processed are moved, the rotary shaft being vertically movable and rotatable; and a housing having grinding and polishing surfaces on which the spherical surfaces of the spherical bodies moving along the path groove are slid. When spherical bodies such as silicon spherical bodies are supplied to the apparatus, the spherical bodies are rolled and moved along the spiral path groove formed in the outer cylindrical surface of the rotary shaft while sliding on the inner surface of the housing, so that the outer surfaces of the spherical bodies are ground and polished until the spherical bodies become high in sphericity.

19 Claims, 6 Drawing Sheets

APPARATUS AND METHOD FOR GRINDING AND POLISHING SPHERICAL BODIES

BACKGROUND OF THE INVENTION

1. Field of the Invention

This invention relates to an apparatus and method for grinding and polishing spherical bodies such as single crystal silicon.

2. Description of the Related Art

Heretofore, a semiconductor device is formed according to the following method: That is, a circuit pattern is formed on a plate-shaped single crystal silicon wafer, and the wafer thus processed is subjected to dicing, to form a semiconductor chip. In this connection, recently a technique has been proposed in the art that a circuit pattern is formed on a spherical single crystal silicon body.

The spherical silicon body produced by the above-described technique must be exactly spherical. However, there has been only need for spherical semiconductor chips, and therefore a grinding and polishing apparatus available is only for silicon wafers; that is, an apparatus for grinding and polishing spherical single crystal silicon bodies are not available.

An example of a conventional spherical body grinding and polishing apparatus is an apparatus for manufacturing balls for pinball machines or bearings. Spherical silicon bodies must be considerably high in sphericity and must be mirror-finished with high accuracy, and are liable to be scratched and oxidized. With the apparatus, it is difficult to continuously a number of such spherical silicon bodies in an in-line system, and it is impossible to obtain spherical bodies high in sphericity.

SUMMARY OF THE INVENTION

Accordingly, an object of the invention is to eliminate the above-described difficulties accompanying a conventional spherical body grinding and polishing apparatus.

More specifically, an object of the invention is to provide a spherical body grinding and polishing apparatus which is able to grind and polish spherical bodies with high efficiency, and to readily produce spherical bodies high sphericity with high productivity.

The foregoing object and other objects of the invention have been achieved by the provision of a spherical body grinding and polishing apparatus which, according to the invention, comprises: a rotary shaft having a spiral path groove in the outer cylindrical surface along which spherical bodies to be processed are moved, the rotary shaft being vertically movable and rotatable; and a housing having grinding and polishing surfaces on which the spherical surfaces of the spherical bodies are slid which move along the path groove. The spherical bodies are being rolled and moved along the spiral path groove formed in the outer cylindrical surface of the rotary shaft while being in contact with the grinding and polishing inner surface of the housing, so that the outer surfaces of the spherical bodies are ground and polished high in sphericity.

The apparatus of the invention is applicable not only to spherical bodies such as semiconductor spherical bodies but also those such as steel ball, ceramic balls and resin ball. With the apparatus, the size of spherical bodies which can be ground and polished high in sphericity is in the range of from about 0.1 mm to about 10 mm. In the case of a spherical body 1 mm in diameter, resultant sphericity is high, ±0.2 $\mu$m.

In the secondaspect of the invention, instead of the rotary shaft, the housing is made rotatable and vertically movable In the third aspect of the invention, silicon spherical bodies are supplied to the path groove of the first or second aspect of the apparatus and the silicon spherical balls are ground and polished while being slid on the grinding and polishing surfaces, so that silicon spherical bodies whose surfaces are mirror-polished are obtained.

The nature, utility and principle of the invention will be more clearly understood from the following detailed description and the appended claims when read in conjunction with the accompanying drawings.

PREFERRED EMBODIMENT OF THE INVENTION

Figure 1:
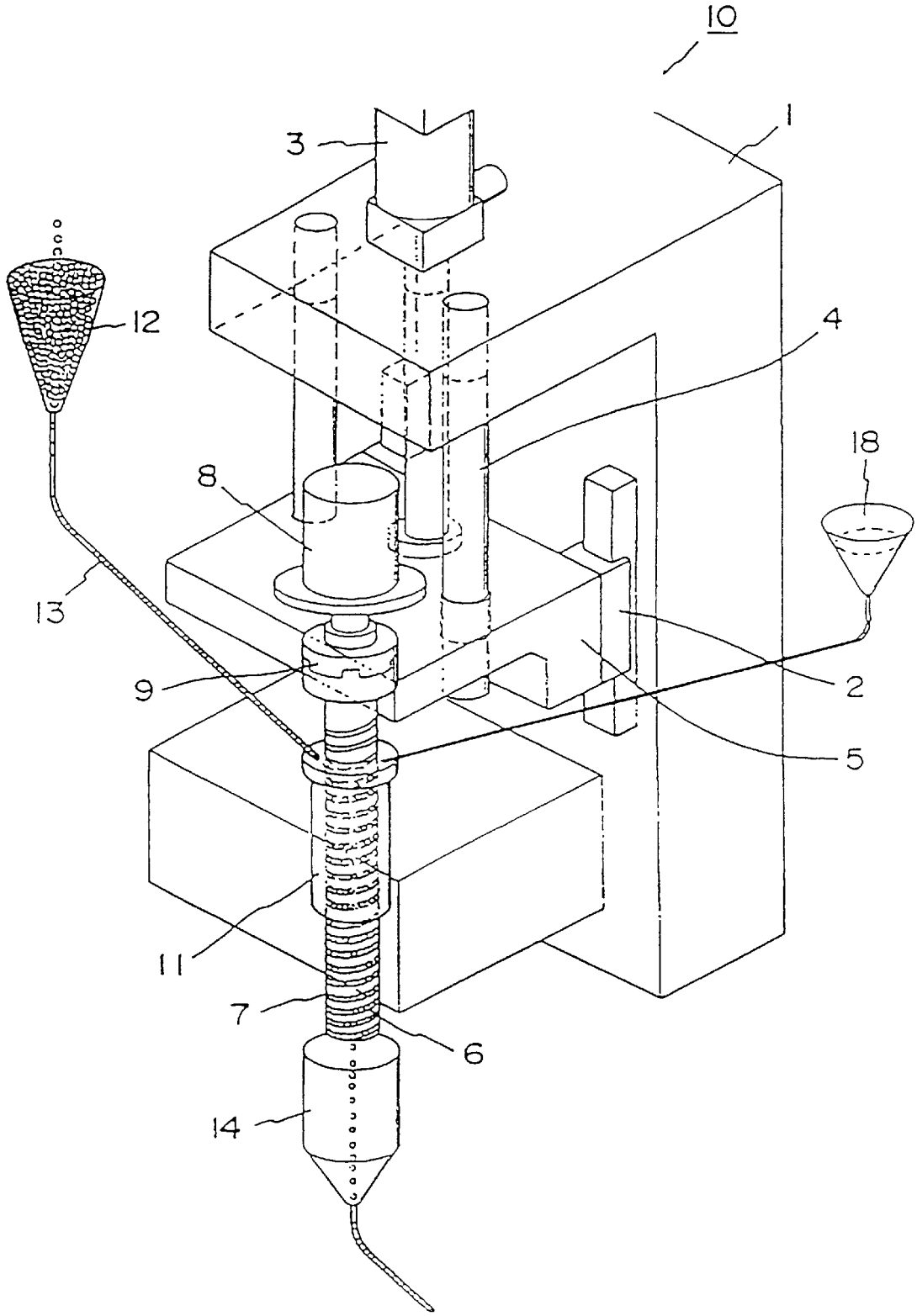
FIG. 1 is an explanatory diagram showing the whole structure of an example of a spherical body grinding and polishing apparatus, which constitutes a first embodiment of the invention.

Preferred embodiments of the invention will be described below; however, the invention is not limited thereto or thereby.

With a spherical body grinding and polishing apparatus of the invention, a single crystal silicon spherical body 1 mm in diameter is formed which is for the formation of a semiconductor integrated circuit.

First Embodiment

As was described above, FIG. 1 shows the whole structure 10 of an example of a spherical body grinding and polishing apparatus, which constitutes a first embodiment of the invention. The apparatus includes: a base stand 1; and a supporting stand 5 which is supported by an up-and-down guide 2 provided on the base stand 1, and is moved up and down by an up-and-down stroke cylinder 3 and a supporter 4. A rotary shaft 7 is mounted on the supporting stand 5. The rotary shaft 7 has a spiral path groove 6 in the outer cylindrical surface in which single crystal silicon spherical bodies are allowed to move on which are spherical bodies to be ground and polished. The rotary shaft 7 is connected through a coupling 9 to a rotating electric motor so that it is rotated.

Furthermore, a housing 11 is provided in such a manner as to surround the rotary shaft 7. A hopper 12 accommodating single-crystal silicon spherical bodies M is provided obliquely upwardly of the housing 11. The spherical bodies M in the hopper 12 are supplied through chute 13 into the space between the path groove 6 and the rotary shaft and the housing by their own gravities . As the rotary shaft moved up and down and rotated, the spherical bodies thus supplied are brought into slide contact with a layer of abrasive grain formed on the inner surface of the housing 11, so that the outer spherical surface of each of the spherical bodies are uniformly ground and polished; that is the spherical bodies become exactly spherical. In FIG. 1, reference numeral 14 designates a pool for polished single crystal silicon spherical bodies. The spherical bodies are discharged from the bottom of the pool. Reference numeral 18 denotes a device for supplying a spherical-body grinding and polishing accelerating agent, namely, a polishing agent.

Figure 2:
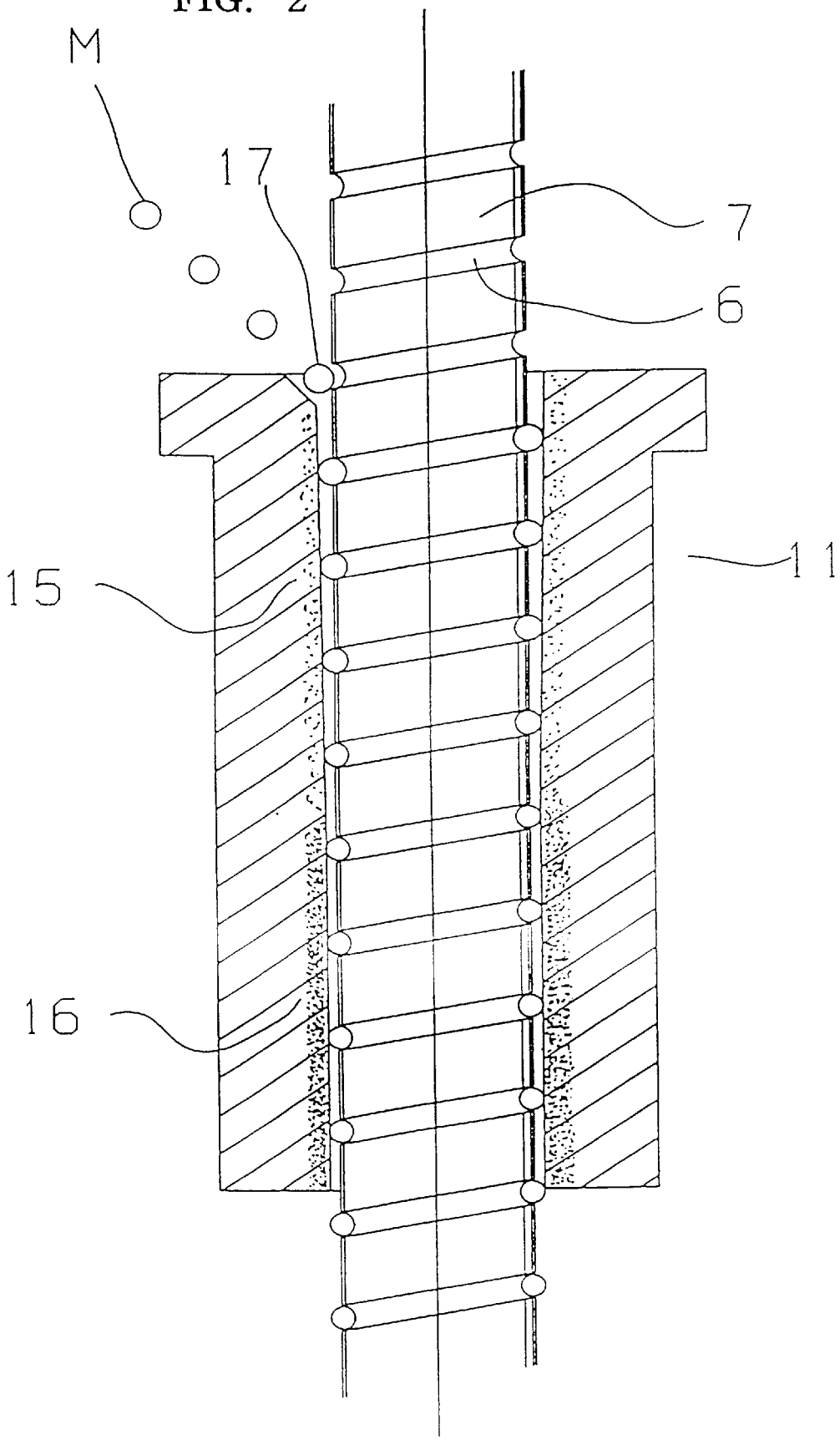
FIG. 2 is a sectional view of a housing in the apparatus shown in FIG. 1.

As was described above, FIG. 2 is an enlarged sectional view showing essential parts of the rotary shaft 7 and the housing 11. The rotary shaft 7, which is vertically movable, is of metal. In order that the spherical body may freely rotated in the groove, the spiral path groove 6 formed in the outer cylindrical surface of the rotary shaft 7 is slightly larger in diameter than the spherical body 4, and the section of the spherical body M whose depth is substantially a half of the diameter of the spherical body M, is semi-circular.

The inner cylindrical surface of the housing 11 provided around the rotary shaft 7 is made up or a grinding region 15 whose diameter is gradually decreased towards the lower end of the housing in correspondence the change in diameter of a spherical body supplied (from the diameter of a spherical body supplied to the diameter of the spherical body finished), and a polishing region 16 which is substantially vertical. The grinding region is made up of a layer of abrasive grains such as fine diamonds and borazons.

It is preferable that the lengths of the grinding region 15 and the polishing region 16 are changed according to the hardness and size of a spherical body to be ground and polished and to the precision of the aimed finished surface of the same.

As shown in FIG. 1, silicon spherical bodies M are supplied from the chute 13 into the grinding region 15 through the upper opening 17 defined by the rotary shaft 7 and the housing 11. The spherical bodies M thus supplied are forcibly brought into contact with the layer of abrasive grains of the grinding region 15 while being rotated by the rotation and vertical movement of the rotary shaft 7, so that the spherical surface of each of the spherical bodies M is uniformed ground, and thereafter finish-polished in the polishing region 16. By the rotation and vertical movement of the rotary shaft 7, the spherical surfaces of the spherical bodies M are efficiently mirror-polished without being scratched. Thus, silicon spherical bodies considerably high in surface condition are formed in the housing which is a closed space.

The amount of supply of the polishing agent from the polishing agent supply device is suitably adjusted according to the degree of advance of a grinding or operation.

Single crystal silicon spherical bodies which have been polished are dried by a cathode washing process or anode washing process, and are then conveyed to the following circuit pattern forming process. In this case, the single crystal silicon spherical bodies can be delivered to the following film forming process while being insulated from the outside air; that is, the spherical bodies can be protected from contamination and improved in yield.

The above-described housing may be modified as follows: That is, it is made up of a grinding region tapered in section in which the distance between the housing and the surface of the path groove of the rotary shaft is gradually decreased towards the lower end of the housing, and a polishing region vertically straight in section in which the distance between the housing and the surface of the path groove is constant.

Second Embodiment

Another example of the spherical body grinding and polishing apparatus, which constitutes a second embodiment of the invention, will be described with reference to FIG. 3.

Figure 3:
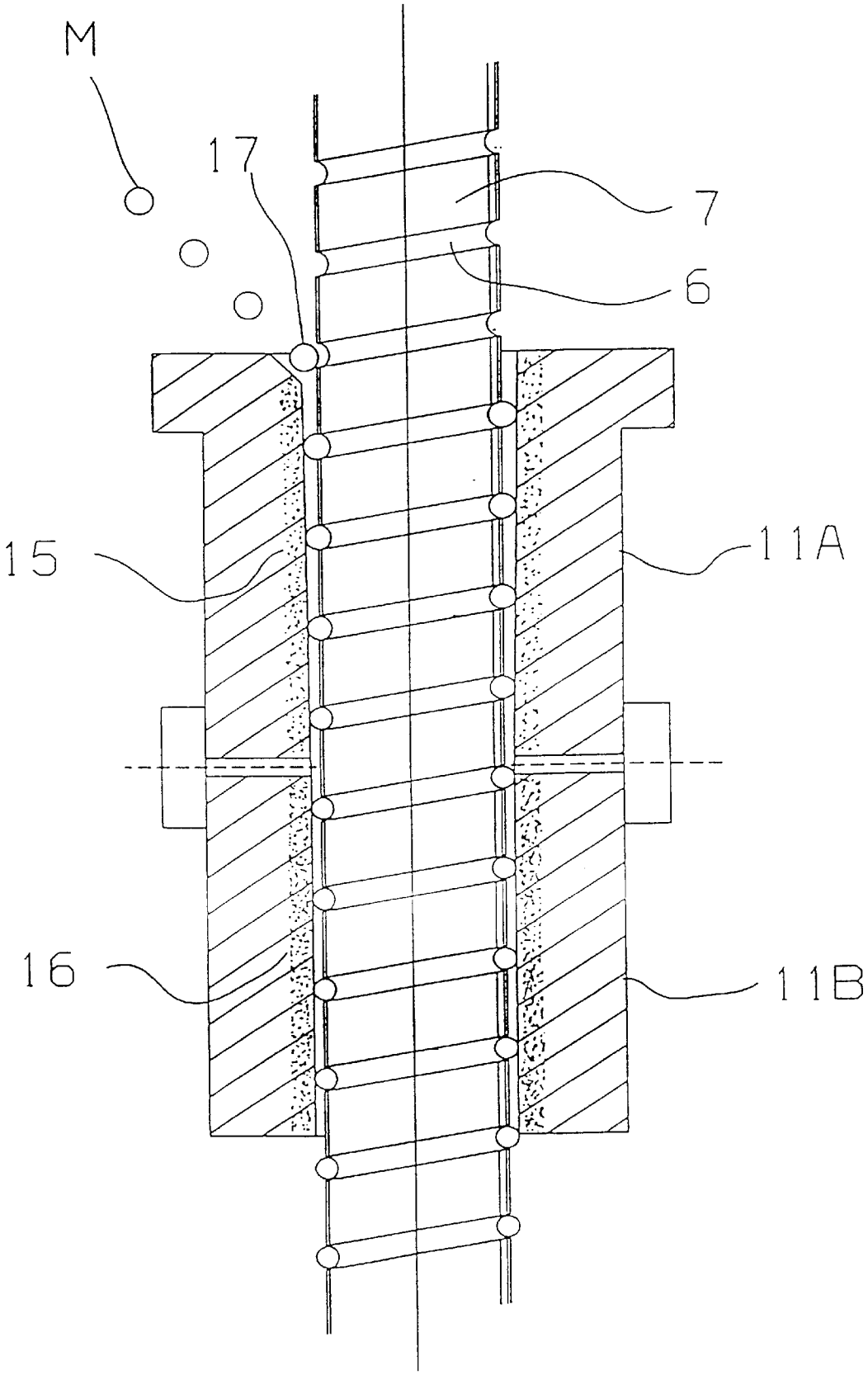
FIG. 3 is a sectional view for a description of another example of the spherical body grinding and polishing apparatus, which constitutes a second embodiment of the invention.

As shown in FIG. 3, the aforementioned housing is divided into two parts; that is, a first separate chamber 11A and a second separate chamber 11B. In the first separate chamber 11A, a grinding operation is performed; and in the second separate chamber, a polishing operation is performed.

Third Embodiment

Figure 4:
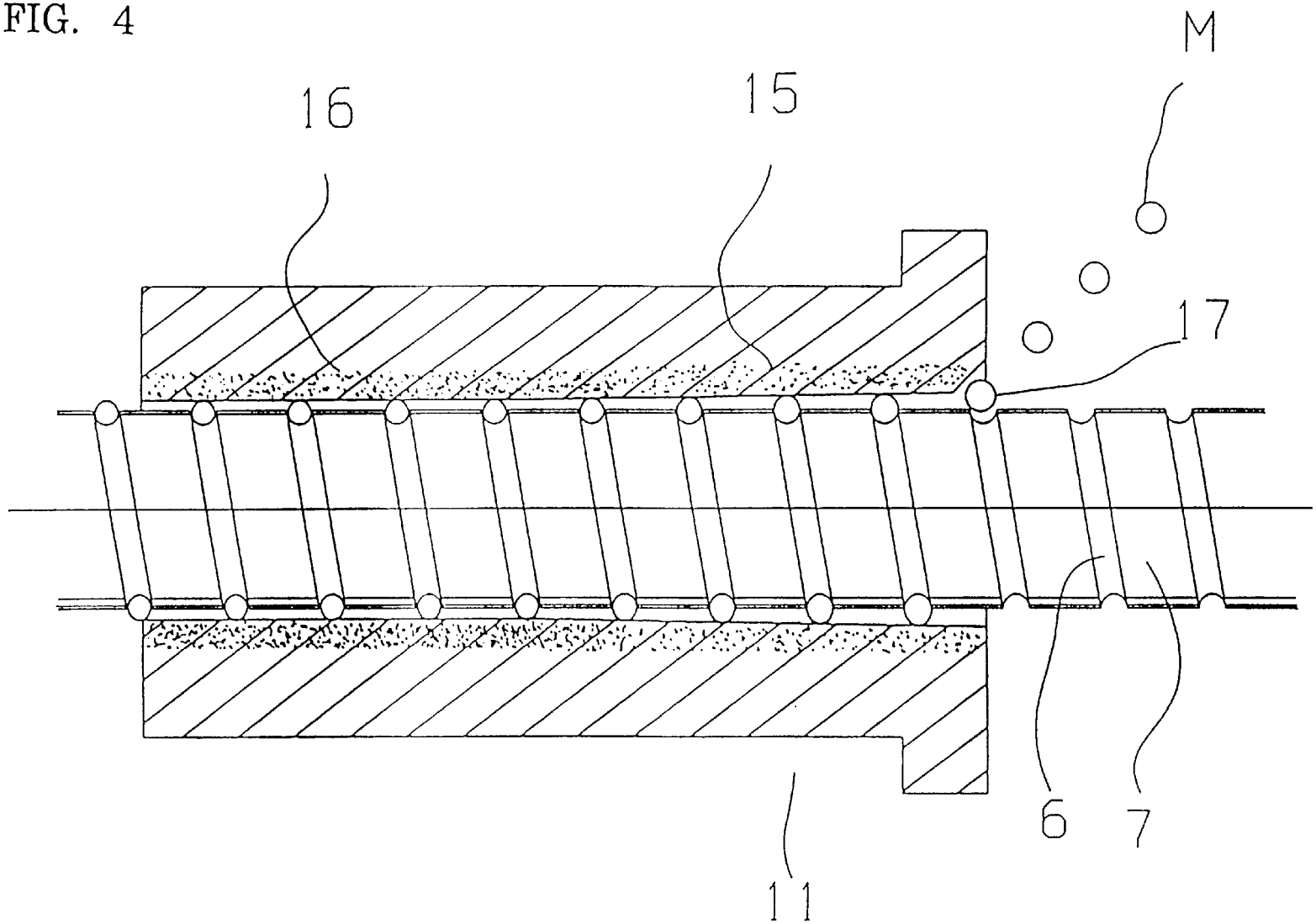
FIG. 4 is a sectional view for a description of another example of the spherical body grinding and polishing apparatus, which constitutes a third embodiment of the invention.

Another example of the spherical body grinding and polishing apparatus, which constitutes a third embodiment of the invention, will be described with reference to FIG. 4.

In the first embodiment described above, the housing 11 is held vertical. In the third embodiment, as shown in FIG. 4, the housing is laid horizontal. In this case, the polishing agent is uniformly brought into contact with single crystal spherical bodies to be processed, so that the resultant spherical bodies are higher in sphericity.

Fourth Embodiment

Another example of the spherical body grinding and polishing apparatus, which constitutes a fourth embodiment of the invention, will be described with reference to FIG. 5.

Figure 5:
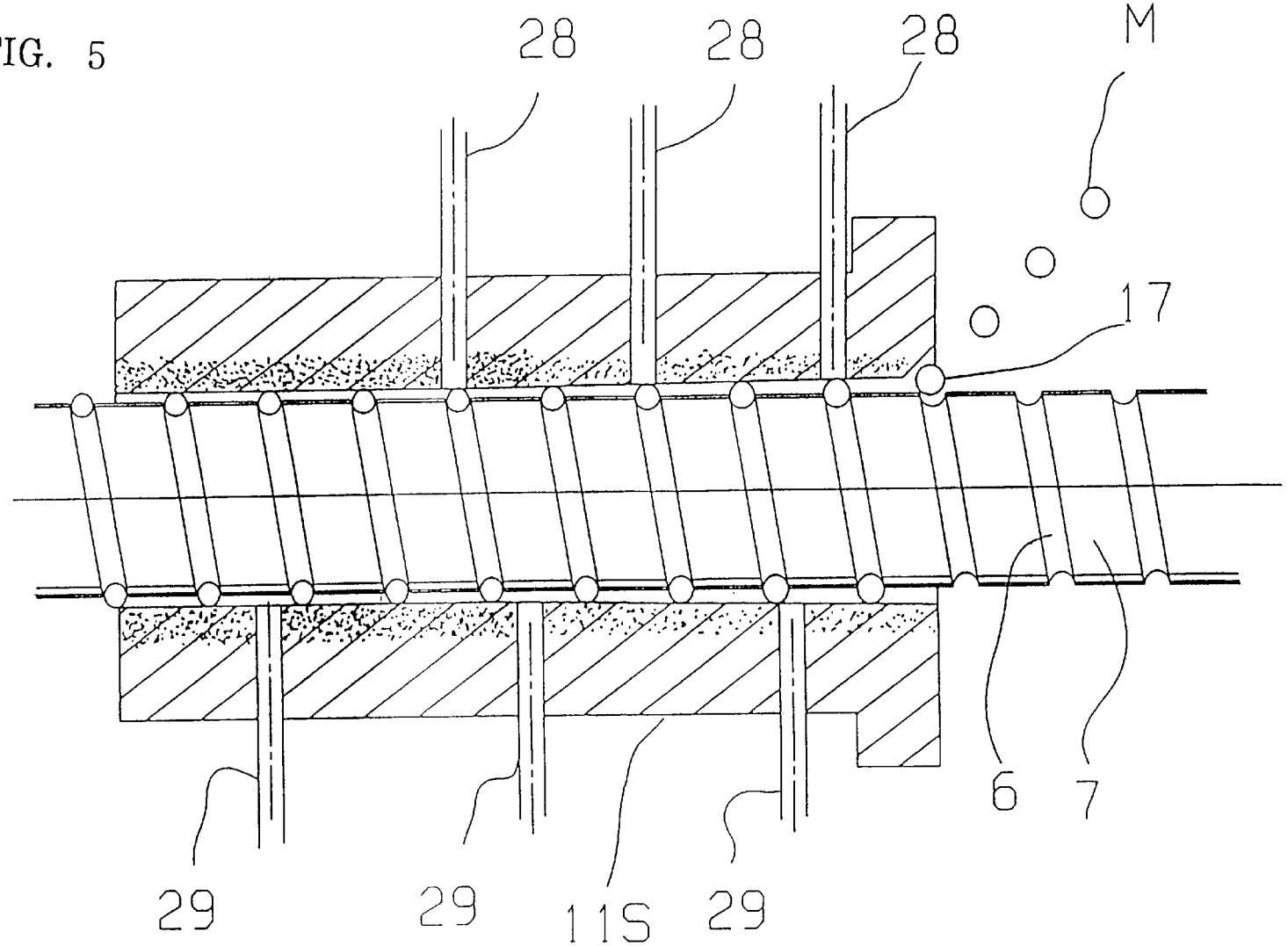
FIG. 5 is a sectional view for a description of another example of the spherical body grinding and polishing apparatus, which constitutes a fourth embodiment of the invention.

As shown in FIG. 5, a housing 11S is laid horizontal, and the housing 11S thus laid has a plurality of polishing agent supply inlets 28 which are formed in the upper portion of the cylindrical wall of the housing at predetermined intervals in such a manner that those inlets 28 are lined longitudinally of the housing, and a plurality of polishing agent discharge outlets 29 which are formed in the lower portion of the cylindrical wall of the housing in the same manner as the inlets 28. In this case, the polishing agent is more uniformly brought into contact with the silicon single crystal spherical bodies, and are smoothly discharged. Hence, the spherical bodies are mirror-polished with high efficiency and with high reliability.

In the embodiment, the polishing agent supply inlets are formed in the upper portion of the cylindrical wall of the housing, while the polishing agent discharge outlets are formed in the lower portion of the cylindrical wall of the housing; however the polishing agent supply inlets may be formed in the lower portion of the cylindrical wall of the housing, and accordingly the polishing agent discharge outlets may be formed in the upper portion of the cylindrical wall of the housing.

In the first embodiment shown in FIG. 1, the housing 11 has the pool downstream of the polishing region thereof which temporarily accommodates the spherical bodies which have been polished up. The spherical bodies thus accommodated may be arranged in a line and delivered to the following circuit pattern forming process. Hence, the pattern forming operation can be achieved without the spherical bodies touching the external air. Silicon spherical bodies are liable to be oxidized when touching the external air. That is, when the spherical bodies contact the external air, natural oxide films are formed thereon, which may often decrease the contact resistance. In addition, the contamination thereof may unavoidably cause short-circuiting. Those difficulties are eliminated by the fourth embodiment.

Fifth Embodiment

Another example of the spherical body grinding and polishing apparatus, which constitutes a fifth embodiment of the invention, will be described with reference to FIG. 6.

Figure 6:
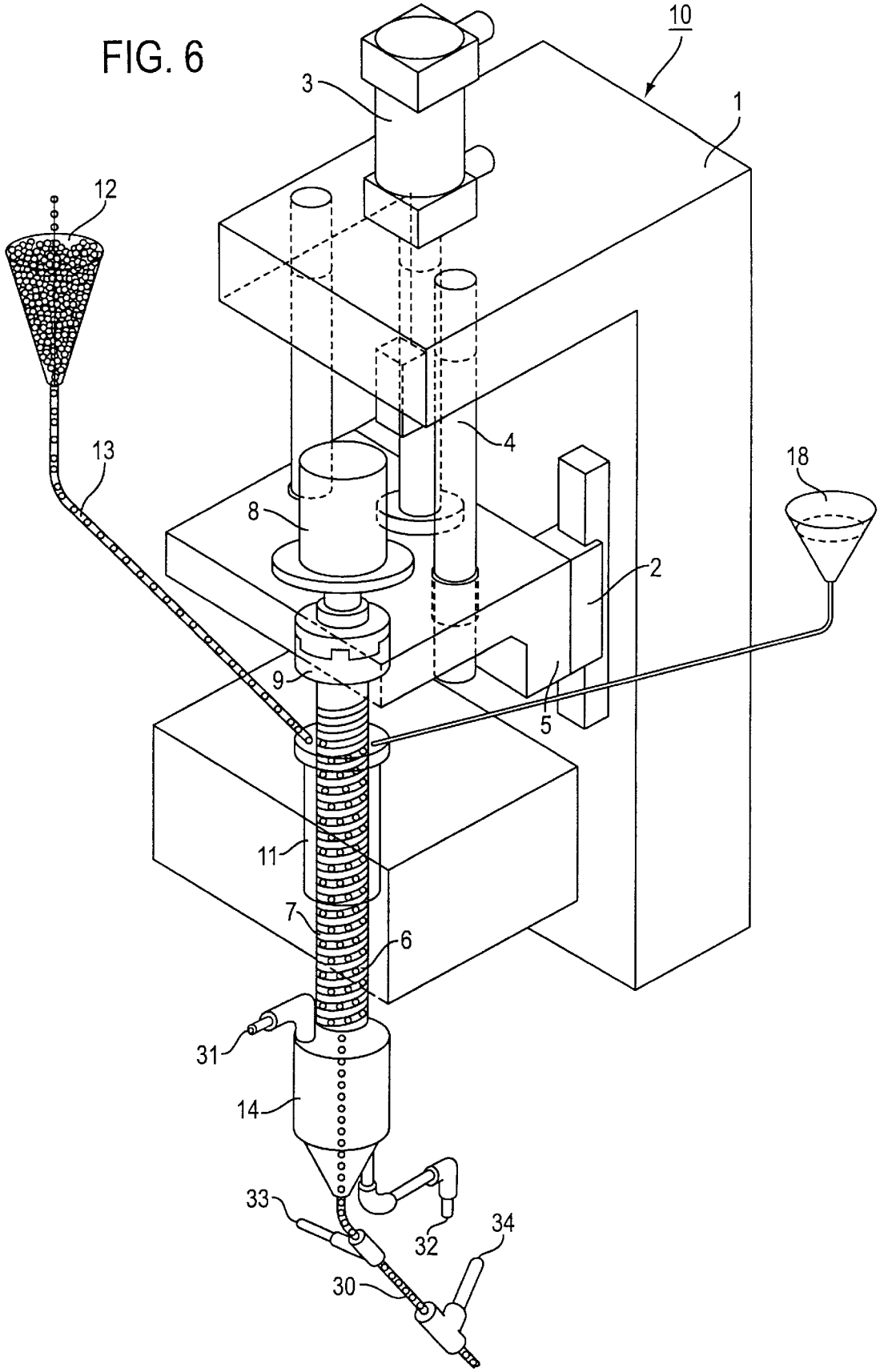
FIG. 6 is a sectional view for a description of another example of the spherical body grinding and polishing apparatus, which constitutes a sixth embodiment of the invention.

As shown in FIG. 6, the pool is provided with a cleaning-water supplying section 31 for supplying cleaning water, and a cleaning-water discharging section 32 for discharging the cleaning water used for cleaning the spherical bodies. In the fifth embodiment, the spherical bodies which have been polished are cleaned with cleaning water. That is, while the spherical bodies which have been polished are accommodated in the pool, they are washed, which shortens the time required form the manufacturing of spherical bodies. Furthermore, an inert gas supply inlet 33 and an inert gas discharge outlet 34 are provided downstream of the cleaning water supplying section 31 and the cleaning water discharging section, so that the spherical bodies which have been washed are dried.

The aforementioned pool 14 has a conveying pipe 30 adapted to convey the spherical bodies one by one which have been arranged in a line. It is preferable that a revolving-stream forming means is provided in the conveying pipe 30 so that the spherical bodies are conveyed on the revolving stream. This feature prevents the surfaces of the spherical bodies from being scratched, and decreases the percentage of formation of unacceptable circuit patterns.

In the above-described embodiments, spherical bodies to be processed are single crystal silicon spherical bodies; however, it goes without saying that the technical concept of the invention is applicable to poly-crystalline silicon spherical bodies.

Furthermore, in the above-described first embodiment, the rotary shaft is rotatable and vertically movable; however, instead the apparatus may be so modified that the housing is rotatable and vertically movable.

As is apparent from the above description, the invention has the following effects or merits:

(1) Spherical bodies high in sphericity can be obtained independently of the material thereof.

(2) Two kinds of surface treatment, a grinding operation and a polishing operation, can be achieved simultaneously; that is, the apparatus of the invention is high in manufacture efficiency.

(3) The surfaces of silicon spherical bodies which are liable to be scratched and oxidized, can be finely mirrorpolished.

(4) The apparatus is made up of unit components as a whole, and therefore the apparatus can be assembled with ease, and is simple in maintenance.

(5) The rotary shaft, and the grinding and polishing housing may be made of a hard material such as high speed steel, dies steel, and ceramic. The technical concept of the invention is applicable to a variety of ball diameters.

While there has been described in connection with the preferred embodiment of the invention, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. A spherical body grinding and polishing apparatus comprising:

a rotary shaft having a spiral path groove in an outer cylindrical surface along which spherical bodies to be processed are moved, said rotary shaft being vertically movable and rotatable; and a housing having grinding and polishing surfaces on which spherical surfaces of said spherical bodies moving along said path groove are slid.

2. The spherical body grinding and polishing apparatus as claimed in claim 1, further comprising a polishing agent supplying device which is provided above said housing.

3. The spherical body grinding and polishing apparatus as claimed in claim 2, wherein said housing comprises:

a grinding region tapered in such a manner the distance between the housing and the outer surface of said path groove of said rotary shaft decreasing gradually from a first end towards a second end of the grinding region; and a polishing region which is adjacent to said grinding region, and is straight in section so that the distance between said housing and the outer surface of said path groove of said rotary shaft is constant.

4. The spherical body grinding and polishing apparatus as claimed in claim 1, wherein said housing is divided into a plurality of chambers which are connected in series to one another.

5. The spherical body grinding and polishing apparatus as claimed in claim 1, wherein said housing is arranged vertical.

6. The spherical body grinding and polishing apparatus as claimed in claim 1, wherein said housing is arranged horizontal.

7. The spherical body grinding and polishing apparatus as claimed in claim 6, wherein said housing has a plurality of polishing-agent supplying inlets and a plurality of polishing-agent discharging outlets formed therein at predetermined intervals.

8. The spherical body grinding and polishing apparatus as claimed in claim 7, in which said plurality of polishing-agent supplying inlets are provided in an upper portion of the cylindrical wall of said housing, while said plurality of polishing-agent discharging outlets are provided in the lower portion of the cylindrical wall of said housing.

9. The spherical body grinding and polishing apparatus as claimed in claim 1, wherein said grinding region of said housing is made up of a layer of abrasive grains of diamonds.

10. The spherical body grinding and polishing apparatus as claimed in claim 1, wherein said polishing region of said housing is made up of a layer of abrasive grains of minute diamonds.

11. The spherical body grinding and polishing apparatus as claimed in claim 1, wherein said housing has a pool downstream of said polishing region which is larger in diameter than said housing, to temporarily accommodate spherical bodies which have been polished up.

12. The spherical body grinding and polishing apparatus as claimed in claim 11, wherein said pool has a cleaning-water supplying section for supplying cleaning water, and a cleaning-water discharging section for discharging a used cleaning water, to clean spherical bodies which have been polished up.

13. The spherical body grinding and polishing apparatus as claimed in claim 3, further comprising: gas supplying means for supplying inert gas downstream of said polishing region of said housing, to dry spherical bodies which have been polished up.

14. The spherical body grinding and polishing apparatus as claimed in claim 11, wherein said pool is connected to a conveying pipe to sending out spherical bodies one by one which have been polished up.

15. The spherical body grinding and polishing apparatus as claimed in claim 1, wherein said spherical bodies to be processed are of single crystal silicon.

16. The spherical body grinding and polishing apparatus as claimed in claim 1, in which said spherical bodies to be processed are of poly-crystalline silicon.

17. The spherical body grinding and polishing apparatus as claimed in claim 3, in which said path groove formed in the outer cylindrical surface of said rotary shaft gradually decreases in depth towards the second end of said grinding region.

18. A spherical body grinding and polishing apparatus comprising:

a housing which has a spiral path grooves in the inner cylindrical surface along which spherical bodies to be processed are moved on, said housing being rotatable and vertically movable; and a slide shaft which is arranged in said housing, and has grinding and polishing surfaces on which the spherical surfaces of said spherical bodies moving along said path groove are slid.

19. A spherical body grinding and polishing method, using the apparatus as claimed in claim 1, comprising the steps of:

supplying silicon spherical bodies into said path groove; and rotating said rotary shaft, so as to grind and polish said silicon spherical bodies while sliding said silicon spherical bodies on said grinding and polishing surfaces, whereby silicon spherical bodies whose surfaces are mirror-polished are obtained.

* * * * *

UNITED STATES PATENT AND TRADEMARK OFFICE

CERTIFICATE OF CORRECTION

PATENT NO. : 6,071,179

DATED : June 6, 2000

INVENTOR(S) : N. SAKAI et al.

It is certified that error appears in the above-identified patent and that said Letters Patent is hereby corrected as shown below:

At column 6, line 44 (claim 8, line 5) of the printed patent, "the" should be ---a---.

At column 6, line 47 (claim 9, line 2) of the printed patent, "1" should be ---3---.

At column 6, line 51 (claim 10, line 2) of the printed patent, "1" should be ---3---.

At column 6, line 54 (claim 11, line 2) of the printed patent, "1" should be ---3---.

At column 8, line 1 (claim 18, line 3) of the printed patent, "grooves in the inner" should be ---groove in an inner---.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*